US006722070B2

(12) United States Patent
Ribaudo

(10) Patent No.: US 6,722,070 B2
(45) Date of Patent: Apr. 20, 2004

(54) SPORTS MEMORABILIA/CARD DISPLAY

(76) Inventor: Michael D. Ribaudo, 6005 Cumming Ave., Superior, WI (US) 54880

( * ) Notice: Subject to any disclaimer, the term of this patent is extended or adjusted under 35 U.S.C. 154(b) by 0 days.

(21) Appl. No.: 10/218,976

(22) Filed: Aug. 14, 2002

(65) Prior Publication Data

US 2003/0033745 A1 Feb. 20, 2003

Related U.S. Application Data

(60) Provisional application No. 60/312,266, filed on Aug. 14, 2001.

(51) Int. Cl.[7] ..... A47G 1/12; A47G 1/06

(52) U.S. Cl. ..... 40/800; 40/735

(58) Field of Search ..... 40/800, 735

(56) References Cited

U.S. PATENT DOCUMENTS

| | | | | |
|---|---|---|---|---|
| 3,473,247 A | | 10/1969 | Favor et al. | 40/126 |
| 5,249,683 A | | 10/1993 | Baucom | 206/462 |
| 5,277,949 A | | 1/1994 | Green | 428/13 |
| 5,339,547 A | | 8/1994 | Fogel | 40/124 |
| 5,477,631 A | | 12/1995 | Hewitt | 40/605 |
| 5,651,202 A | | 7/1997 | Hewitt | 40/605 |
| 5,669,167 A | | 9/1997 | Kemp | 40/642 |
| 5,746,332 A | | 5/1998 | Kleinschmidt | 211/153 |
| 5,783,005 A | * | 7/1998 | Handler | 156/63 |
| 5,803,501 A | | 9/1998 | Gluck | 283/75 |
| 5,820,127 A | | 10/1998 | Rodriguez | 273/280 |
| 5,853,823 A | | 12/1998 | McKenna | 428/7 |
| 6,112,909 A | | 9/2000 | Moseley | 211/32 |
| 6,142,532 A | | 11/2000 | Gluck | 283/75 |
| 6,220,441 B1 | | 4/2001 | Cook | 206/579 |
| 6,447,079 B1 | * | 9/2002 | Irwin | 312/118 |

FOREIGN PATENT DOCUMENTS

| | | | |
|---|---|---|---|
| WO | WO 98/55982 | * 12/1999 | G09F/1/12 |

* cited by examiner

*Primary Examiner*—Cassandra H. Davis
(74) *Attorney, Agent, or Firm*—Westman, Champlin & Kelly, P.A.

(57) ABSTRACT

A display system having a substantially flat front portion for holding and displaying memorabilia. The display system comprises a frame, a backing supported by the frame, a plurality of cardholders for holding photographic memorabilia and a recessed chamber for holding an object of memorabilia associated with the photographic memorabilia. The cardholders retain trading cards and are attachable to the backing. The cardholders are arranged about the chamber in an aesthetic manner.

19 Claims, 2 Drawing Sheets

SPORTS MEMORABILIA/CARD DISPLAY

CROSS-REFERENCE TO RELATED APPLICATION(S)

This application claims priority from U.S. Provisional Application No. 60/312,266, filed Aug. 14, 2001.

BACKGROUND OF THE INVENTION

The present invention relates in general to a display system. More particularly, the present invention is directed to a display case for displaying trading cards or photographs in conjunction with an object of memorabilia, such as a toy car, a golf ball, or a hockey puck.

There is known in the art display cases for holding memorabilia, collectibles and other consumer articles, such as miniature replicas, sport jerseys, hockey pucks, footballs, hats, baseballs, and baseball bats. It has become popular over the years to display such items at various locations including at home, at an office, at a restaurant or at sport bar facilities. Display cases allow the viewer to come within close proximity of the item, and yet protect the item from being damaged by excessive handling.

It is also very popular to collect trading cards of individuals associated with certain sports. Initially, baseball trading cards were sold as an incentive to buy bubble gum. Over the years, however, the trading card industry has flourished, and now many sports or hobbies are enjoyed through collecting trading cards. There exists in the art many types of display cases, including picture frames and the like, which can hold a single or plurality of trading cards.

There exists a need in the art to provide a display system which can hold both trading cards and objects of memorabilia, especially small items or miniature replicas, which are associated with the trading cards displayed therein. It is preferable that the display system be lightweight for easy handling, which also makes it suitable for hanging on walls using simple hanging devices. The display system should also be aesthetically pleasing to coalesce the images of the trading cards along with the selected object of memorabilia.

BRIEF SUMMARY OF THE INVENTION

The present invention is a display system for holding and displaying trading cards in conjunction with an associated object of memorabilia. The display system of the present invention comprises a frame, a plurality of cardholders for holding a trading card or picture, a chamber for holding the object of memorabilia and a support structure. The cardholders and the chamber are positioned within the frame such that the front of the display system is substantially flat.

DETAILED DESCRIPTION

Figure 1:
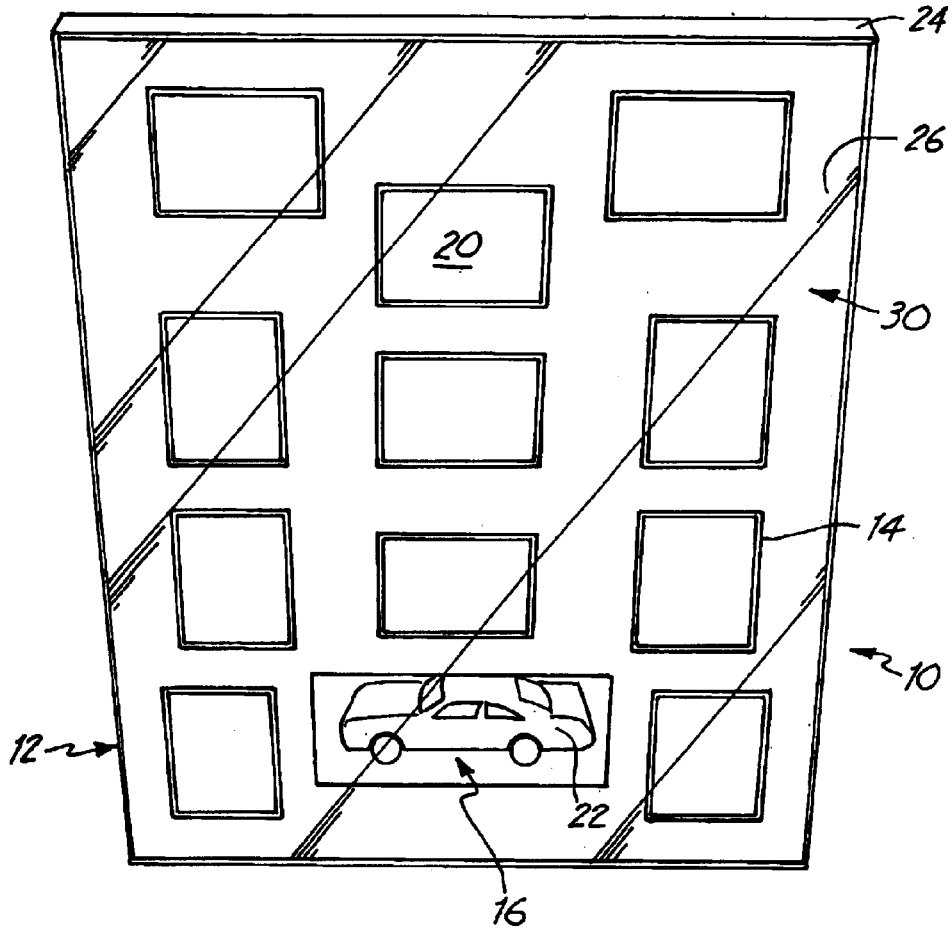
FIG. 1 is a front perspective view of the present invention showing a plurality of cardholders and a chamber containing an object of memorabilia.
Figure 2:
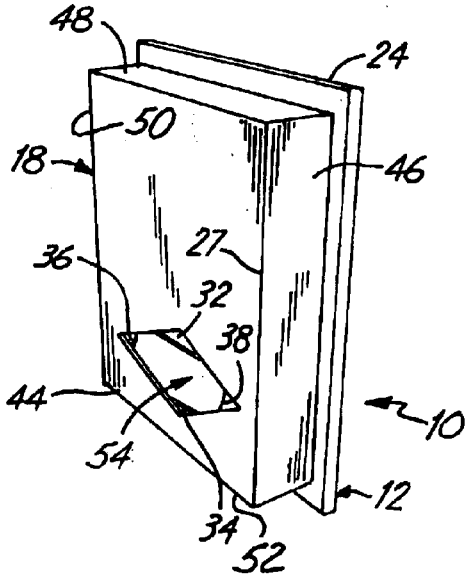
FIG. 2 is a rear perspective view of the display system of the present invention.
Figure 3:
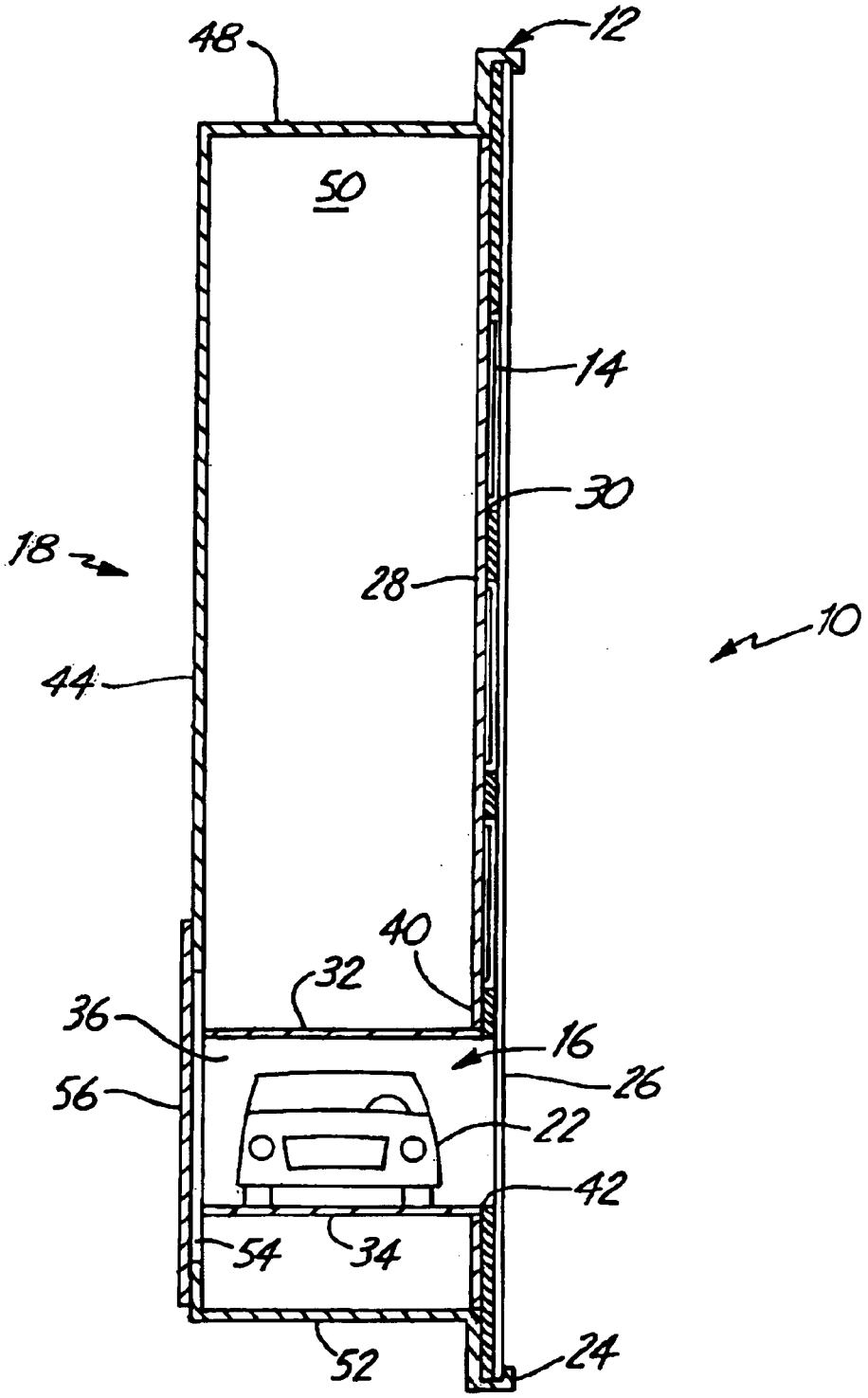
FIG. 3 is a side cutaway view of the display system of the present invention.

A display system of the present invention is generally indicated at 10 in FIGS. 1–3. The display system 10 generally comprises a picture frame 12, card holders 14, a chamber 16 and a mounting structure 18. The card holders 14 are attachable to and arranged about the picture frame 12 in viewable relation to the chamber 16. Preferably, the card holders 14 retain photographic memorabilia 20, such as trading or collectible cards, which are associated with an object of memorabilia 22, such as a miniature replica of a racing car, contained within the chamber 16.

The picture frame 12 includes a molding 24, an optically clear member 26, and a backing 28. The backing 28 is preferably constructed of poster board and includes a decorative finish applied to a front viewable surface 30. The card holders 14 are attached to the front viewable surface 30 of the backing 28, either by a permanent or non-permanent adhesive. The card holders 14 are optically clear so that photographic memorabilia 20 placed within the holders 14 are easily visible. Preferably, photographic memorabilia 20 is meant to include trading cards relating to a sports figure or team. Examples of such trading cards include trading cards relating to NASCAR, National Football League, National Basketball Association, Women's National Basketball Association, Major League Baseball and National Hockey League. Examples of such trading cards include, but are not limited to, those sold under the Trademarks DONRUSS®, FLEER® and TOPPS®. However, other non-exhaustive examples of photographic memorabilia 20 include any type of trading or collectible card, photograph, lithograph, painting, sketch, or depiction which can be inserted within the card holder.

The display system 10 of the present invention also includes the chamber 16 for holding the object of memorabilia 22. The chamber 16, or compartment, is preferably defined by an upper member 32 and a lower member 34, and left and right sidewalls 36 and 38, respectively. The upper and lower members 32 and 34 are preferably substantially parallel to one another, as are the left and right sidewalls 36 and 38. However, it would be within the scope of the present invention to provide any type of chamber 16 which would support an object of memorabilia 22. The lower member 34 of the chamber 16 acts as a platform supporting the object of memorabilia 22 placed thereon. Alternatively, it would be within the scope of the present invention to fixedly secure the object of memorabilia 22 within the chamber by any suitable fastening means. The upper and lower members 32 and 34, along with the sidewalls 36 and 38, are positioned proximate a rear surface 40 of the backing 28 such that the chamber 16 is accessible through an aperture 42 located within the backing 28.

Both the trading card holders 14 and the chamber 16 are positioned within the frame 12, resulting in the front viewable portion of the display system being substantially flat. By substantially flat is meant that, preferably, the card holders 14 and the chamber 16 are located behind the optically clear member 26, with only edges of the molding 24 protruding slightly past the optically clear member 26. The trading card holders 14 and the chamber 16 are protected by the optically clear member 26 extending between and held by the molding 24 of the frame 12. The optically clear member may also retain the object of memorabilia 22 within the chamber 16. The optically clear member 26 is positionable over the backing 28, and the molding 24 retains the backing 28 and the optically clear member 26 within the frame 12. The optically clear member 22 may either be a sheet of glass or a sheet of plastic, as is well known in the art. Preferably all materials used in constructing the display system 10 are acid free.

As illustrated in FIG. 3, the mounting structure 18 may be attached along the border of the frame 12. The mounting structure 18 surrounds and protects the chamber 16. The mounting structure 18 includes a back portion 44 and walls 46, 48, 50 and 52 extending from the back portion 44 of the frame 12. The walls 46, 48, 50 and 52 are of a depth approximately equal to or greater than the depth of the chamber 16. The walls 46, 48, 50 and 52 also provide the display system 10 with a box-like impression. Preferably, the chamber may be accessed through an aperture 54 in the back portion 44 of the mounting structure 18. The aperture 54 is positioned proximate to the chamber walls 32, 34, 36 and 38, and a door 56 may be attachable to back portion 44 to retain the object of memorabilia 22 contained within the chamber 16. Alternatively, the aperture 54 of the back portion 44 may be eliminated, and access to the chamber 16 is provided by removing the optically clear member 26 from the molding 24 of the frame 12.

In the particular example illustrated in FIG. 1, the object of memorabilia 22 is a replica of a NASCAR racing car driven by the driver depicted in the trading cards 20 in the holders 14. As is easily understood, other types of sports memorabilia may be placed within the chamber 16 for display along with trading cards 20 of the particular sports figure. In addition, photographs of a particular event along with memorabilia from that event may also be displayed using the present invention. The event may be a sporting event, or a personal event.

As illustrated in FIG. 1, the card holders 14 are positioned in a selected scheme wherein the card holders 14 are positioned in a viewable relation to the chamber 16. Where each card 20 is positioned to comprise the particular scheme is not critically important, and any other scheme is included within the scope of the present invention. Preferably, the optically clear member 26 defines a plane in which both the trading cards 20 and a viewable opening in the chamber 16, defined by walls 46, 48, 50 and 52, are viewable in relations to one another. Alternatively, this may be defined as the chamber 16 being positioned in a recessed relationship with regard to the card holders 14.

Although the present invention has been described with reference to preferred embodiments, workers skilled in the art will recognize that changes may be made in form and detail without departing from the spirit and scope of the invention.

What is claimed is:

1. A display system having a substantially flat front portion for holding and displaying memorabilia, the display system comprising"

a backing;

a card-holder attached to the backing;

a recessed chamber for holding an object of memorabilia placed therein, the object of memorabilia viewable through the backing in viewable relation to the card-holder, wherein the chamber comprises:

an upper member;

a lower member spaced apart from the upper member, the upper member and the lower member being positioned in a substantially parallel relation;

a first sidewall;

a second sidewall spaced apart from the first sidewall, the first sidewall and the second sidewall being positioned in a substantially parallel relation;

a mounting structure having a back portion; and wherein the upper member, the lower member, the first sidewall and the second sidewall are each positioned between the back portion of the mounting structure and the backing.

2. The display system of claim 1 and further comprising an optically clear member for retaining the object of memorabilia within the chamber.

3. The display system of claim 1 and further comprising:

a frame supporting the backing; and a support structure attached to the frame comprising:

a back portion, the back portion including an aperture;

first and second wall members extending from the back portion, the first and second members engaging the frame; and wherein the second aperture is positioned to access the object of memorabilia.

4. The display system of claim 3 and further comprising a door member positioned proximate the aperture of the back portion and attachable to the back portion.

5. The display system of claim 1 wherein a plurality of card-holders are attached to the backing, the card-holders being arranged in viewable relation proximate the chamber.

6. A display system for holding and displaying memorabilia, the display system comprising:

a frame;

a backing supported by the frame;

a cardholder for holding photographic memorabilia, the cardholder being attachable to the backing;

a recessed chamber positioned within the backing for holding an object of memorabilia;

wherein the cardholder and the chamber are positioned to provide the display system with a substantially flat front portion, wherein the chamber comprises:

an upper member;

a lower member spaced apart from the upper member, the upper member and the lower member being positioned in a substantially parallel relation;

a first sidewall;

a second sidewall spaced apart from the first sidewall, the first sidewall and the second sidewall being positioned in a substantially parallel relation;

a mounting structure having a back portion; and wherein the upper member, the lower member, the first sidewall and the second sidewall are each positioned between the back portion of the mounting structure and the backing.

7. The display system of claim 6 wherein the backing includes a surface defining an aperture, the chamber being positioned in viewable cooperation with the aperture.

8. The display system of claim 6 and further comprising an optically clear member positioned proximate the chamber, wherein the optically clear member retains the object of memorabilia within the chamber, the object of memorabilia being viewable through the optically clear member.

9. This display system of claim 8 wherein the frame comprises a molding to retain the backing and the optically clear member in a selected position.

10. The display system of claim 8 and further comprising a support structure attached to the frame, the support structure comprising:

a back portion, the back portion including a second aperture;

wall members extending from a perimeter of the back portion, the wall members engaging the frame; and wherein the second aperture is positioned to provide access to the chamber.

11. The display system of claim 10 and further comprising a door member attachable to the back portion, the door member being positionable over the second aperture to retain the object of memorabilia within the chamber.

12. The display system of claim 6 wherein the photographic memorabilia is a trading card.

13. The display system of claim 6 wherein the object of memorabilia is a miniature replica of a car.

14. The display system of claim 6 wherein the backing includes a viewable surface, the viewable surface including a design thereon.

15. A display system for holding and displaying memorabilia, the display system comprising:

a backing comprising:

a first forward surface;

a second rearward surface opposing the first surface; and a third surface defining an aperture extending from the first forward surface to the second rearward surface;

a cardholder for holding photographic memorabilia, the cardholder attached to the first forward surface of the backing; and a chamber for holding an object of memorabilia, the object of memorabilia viewable through the aperture, the chamber being positioned proximate the second surface of the backing.

16. The display system of claim 15 and further comprising an optically clear member positioned proximate the backing wherein, the cardholder and the chamber are viewable through the optically clear member.

17. The display system of claim 16 and further comprising a mounting structure, the mounting structure comprising:

a frame;

a back portion, including a back aperture;

first and second members extending from the back portion, the first and second members engaging the frame; and wherein the aperture is positioned to access the chamber, the object of memorabilia insertable through the back aperture.

18. The display system of claim 15 wherein the chamber comprises:

an upper member;

a lower member spaced apart substantially parallel from the upper member;

a first sidewall;

a second sidewall spaced apart substantially parallel from the first sidewall; and wherein the upper member, the lower member, the first sidewall and the second sidewall are each positioned proximate the second surface of the backing.

19. The display system of claim 15 wherein a plurality of cardholders are attached to the backing, the cardholders arranged in viewable relation to the aperture of the backing.

* * * * *

UNITED STATES PATENT AND TRADEMARK OFFICE

CERTIFICATE OF CORRECTION

PATENT NO. : 6,722,070 B2
DATED : April 20, 2004
INVENTOR(S) : Michael D. Ribaudo It is certified that error appears in the above-identified patent and that said Letters Patent is hereby corrected as shown below:

Column 6,
Line 1, delete "16" and insert -- 15 --.

Signed and Sealed this

Twenty-seventh Day of July, 2004

JON W. DUDAS
*Acting Director of the United States Patent and Trademark Office*